United States Patent [19]

Colle

[11] 4,268,192

[45] May 19, 1981

[54] CONCRETE WALL CONSTRUCTION

[75] Inventor: Ervin R. Colle, Haddon Field, N.J.

[73] Assignee: Raymond International Builders, Inc., Houston, Tex.

[21] Appl. No.: 940,967

[22] Filed: Sep. 11, 1978

[51] Int. Cl.[3] ..... E02D 29/00; E02D 27/16

[52] U.S. Cl. ..... 405/239; 405/267; 405/287

[58] Field of Search ..... 405/262, 267, 284, 285, 405/287, 239, 233, 222, 116, 255, 256, 257, 236, 240, 242, 274, 275, 279; 52/169.1, 742, 743

[56] References Cited

U.S. PATENT DOCUMENTS

| | | | |
|---|---|---|---|
| Re. 25,614 | 7/1964 | Turzillo | 405/266 |
| 1,275,912 | 8/1918 | Harding | 405/275 |
| 2,791,886 | 5/1957 | Veder | 405/267 |
| 3,139,729 | 7/1964 | Miotti | 405/267 |
| 3,197,964 | 8/1965 | Fehlman et al. | 405/267 |
| 3,198,614 | 8/1965 | Powell | 405/285 |
| 3,245,222 | 4/1966 | Galaup | 405/267 |
| 3,310,952 | 3/1967 | Veder | 405/267 |
| 3,342,033 | 9/1967 | Crouch et al. | 405/116 |
| 3,345,824 | 10/1967 | Turzillo | 52/169.1 |
| 3,410,095 | 11/1968 | Turzillo et al. | 405/267 |
| 3,422,627 | 1/1969 | Courte | 405/267 |
| 3,429,126 | 2/1969 | Wey | 405/267 |
| 3,431,736 | 3/1969 | Ueda | 52/742 |
| 3,438,207 | 4/1969 | Turzillo | 405/287 |
| 3,492,823 | 2/1970 | Lamberton | 405/233 |
| 3,969,902 | 7/1976 | Ichise et al. | 405/267 |
| 3,973,408 | 8/1976 | Paverman | 405/267 |
| 3,984,989 | 10/1976 | Turzillo | 405/222 |

FOREIGN PATENT DOCUMENTS

| | | | |
|---|---|---|---|
| 1029396 | 5/1966 | United Kingdom | 405/239 |
| 1441473 | 6/1976 | United Kingdom . | |

*Primary Examiner*—Roy D. Frazier
*Assistant Examiner*—Alexander Grosz
*Attorney, Agent, or Firm*—Fitzpatrick, Cella, Harper & Scinto

[57] ABSTRACT

A concrete water retaining wall is formed by driving a plurality of concrete cylinder piles into the earth in closely spaced relationship along a line. Thereafter, elongated tubular flexible bags are inserted down into the spaces between adjacent cylinder piles and a cementitious hardenable material, such as grout, is pumped into the bags to expand them and to form a filler having an hourglass shaped cross section which interlocks with and forms a seal between adjacent piles.

21 Claims, 21 Drawing Figures

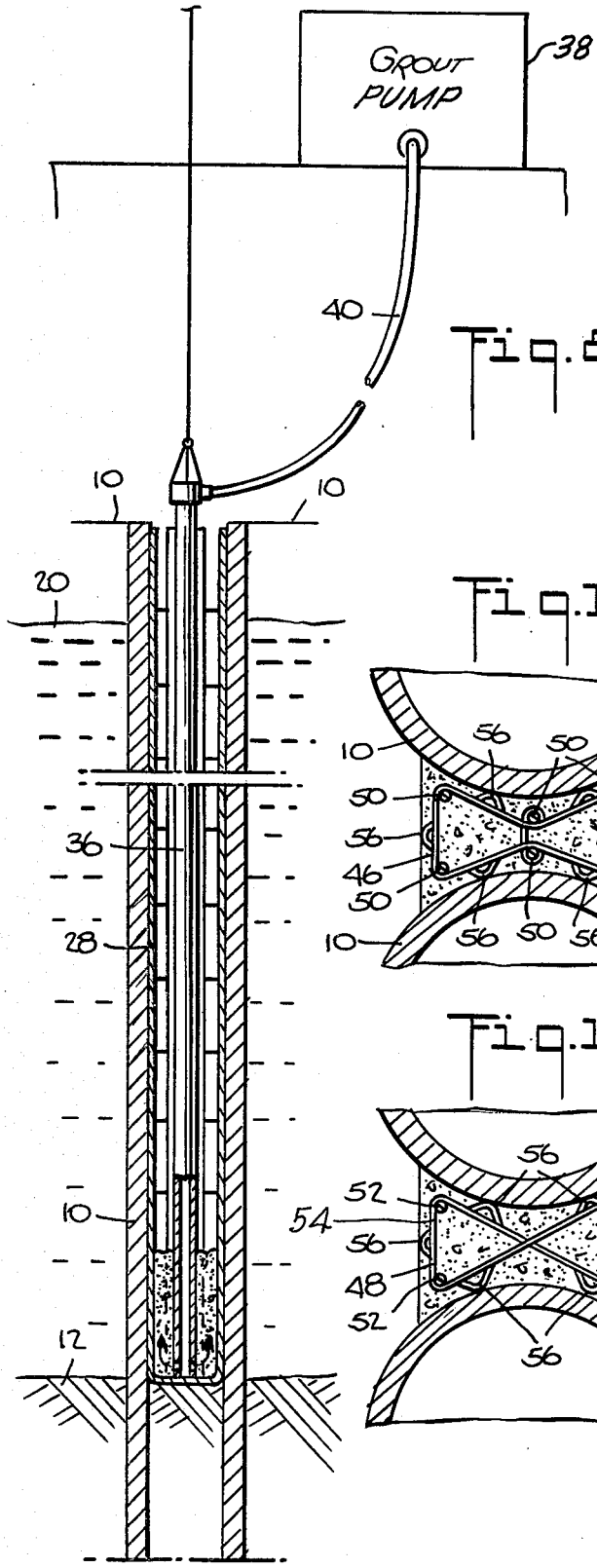
Fig. 8.
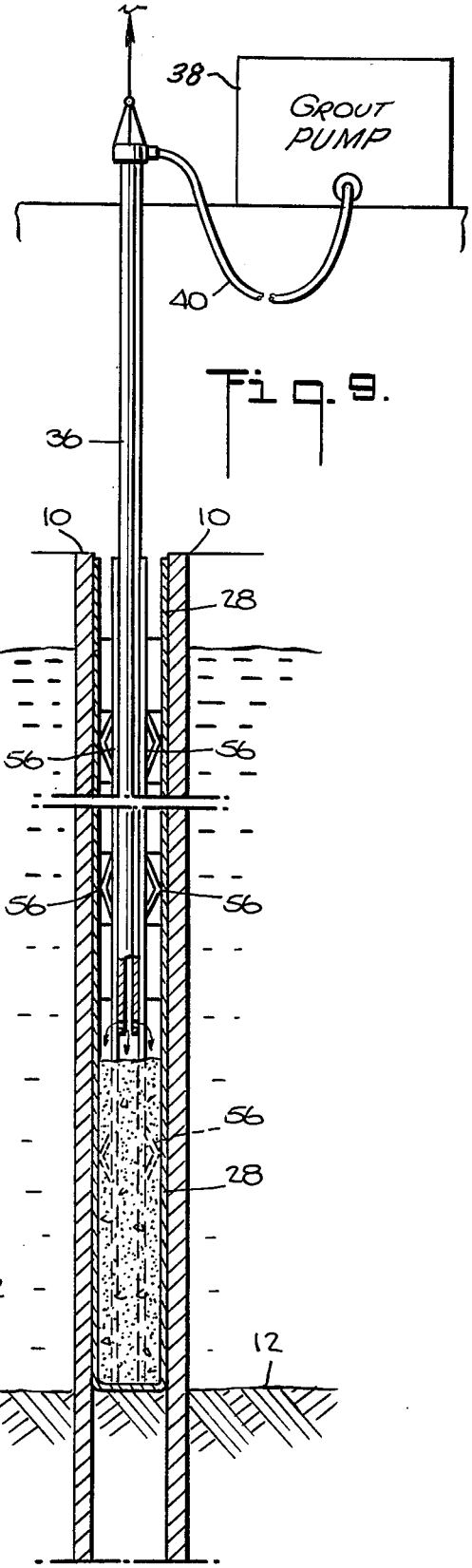
Fig. 9.
Fig. 12.
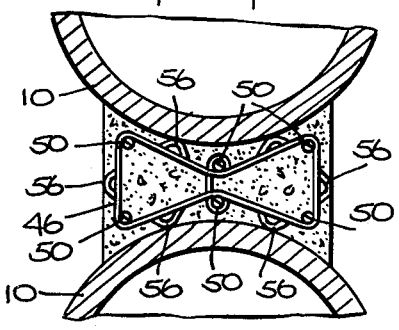
Fig. 13.
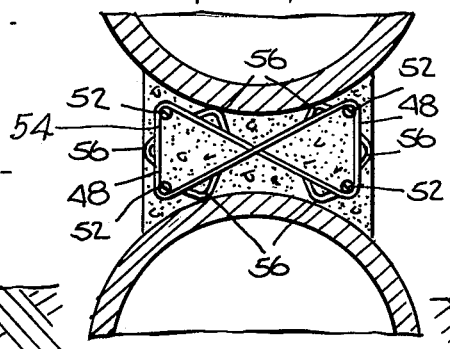

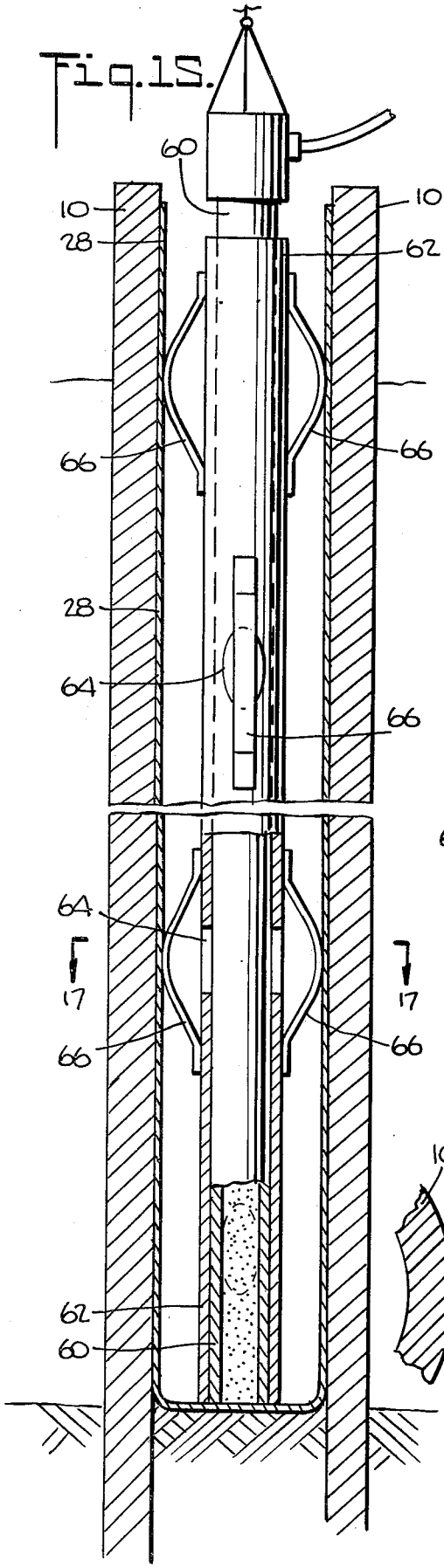
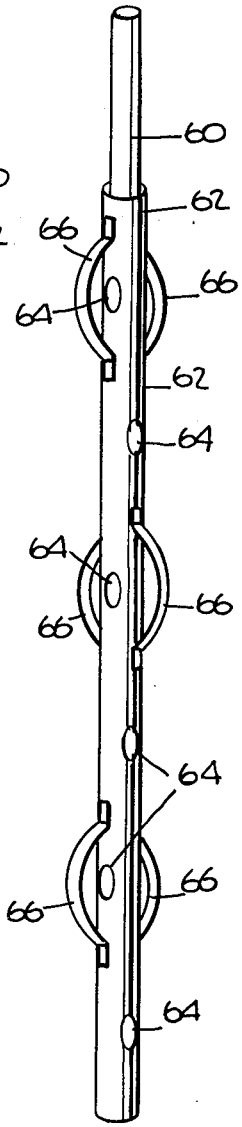
Fig.14.
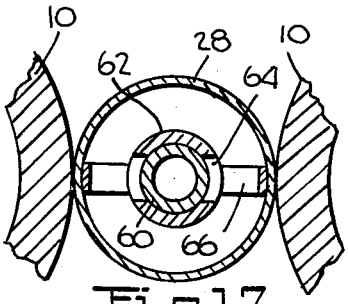
Fig.17.
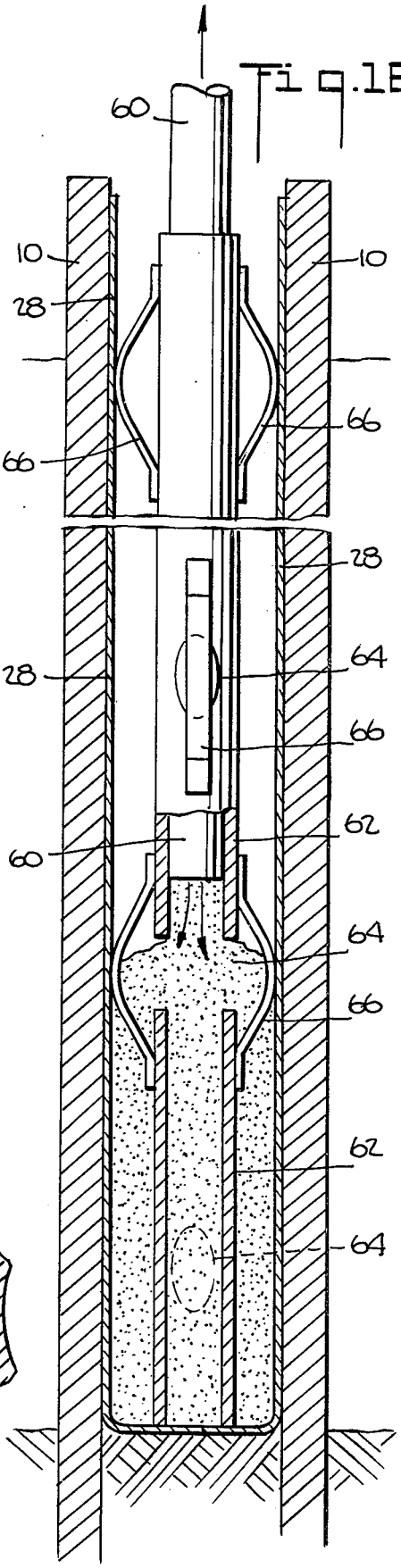

Fig.20.
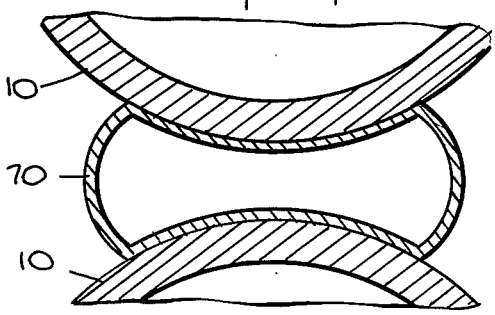
Fig.21.
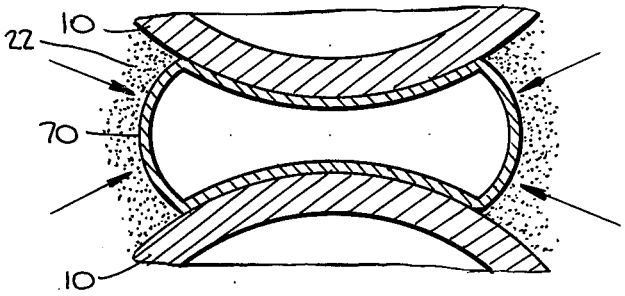
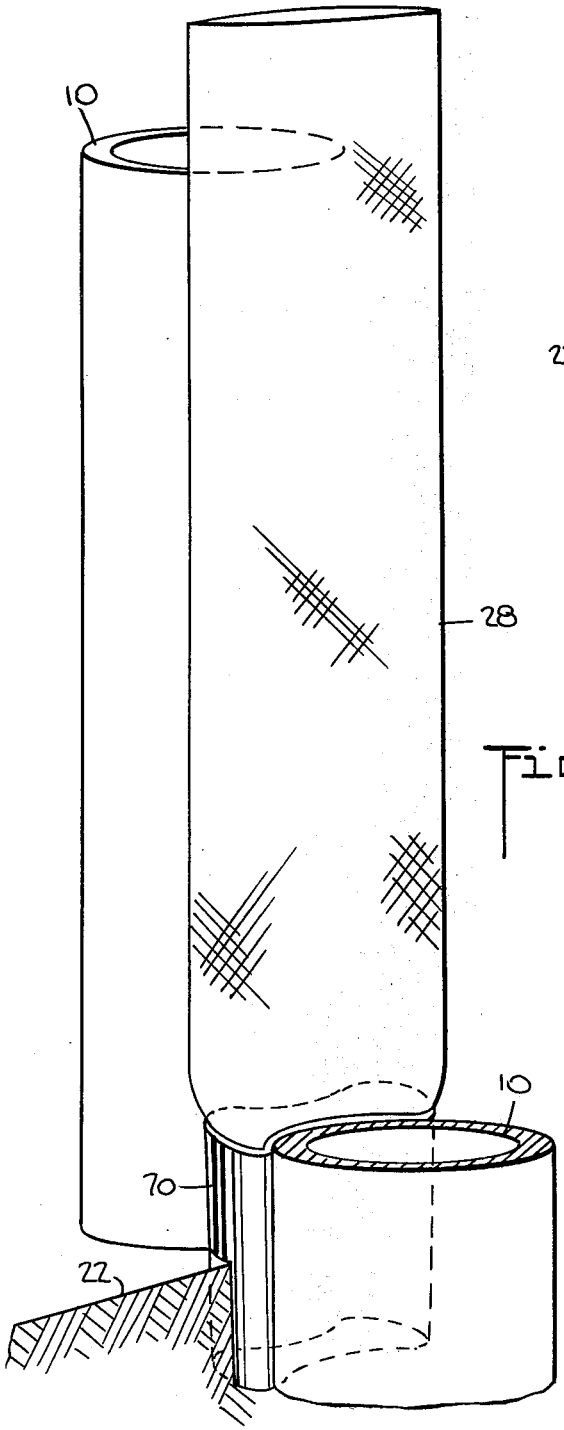
Fig.19.
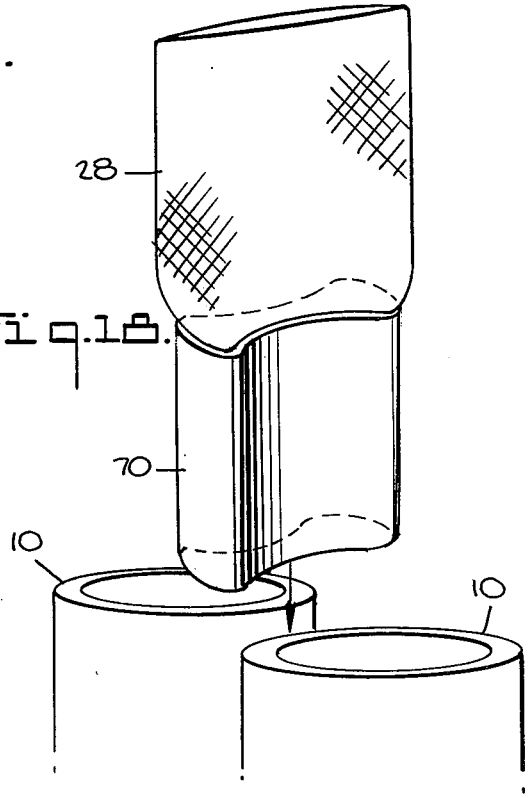
Fig.18.

CONCRETE WALL CONSTRUCTION

BACKGROUND OF THE INVENTION

1. Field of the Invention

This invention relates to wall construction and in particular it concerns the formation of novel water retaining walls supported in the earth.

2. Description of the Prior Art

U.S. Pat. No. 3,984,989 describes arrangements for forming concrete walls by positioning large, rectangularly shaped fabric bags to span the distance between spaced apart, previously driven, metal soldier-beams; and then pumping concrete into the bags. The walls thus formed are not suitable in situations where it is subject to large lateral forces since the spaced apart soldier-beams provide the only resistance to these forces. Also, it would not be practical to employ a large number of closely spaced metal soldier-beams because they are expensive and they are subject to corrosion. Further, the concrete to metal interface at each soldier-beam does not provide a good watertight seal.

Several other United States patents, including U.S. Pat. No. 3,410,095, U.S. Pat. No. 3,438,207 and U.S. Pat. No. 3,492,823 describe various arrangements for constructing concrete retaining walls employing piles and fabric bags filled with concrete. However, all of the arrangements described herein relate to the formation of underground retaining walls which, either during or after construction, are laterally braced by an earth situs. None of these patents involve the construction of a water retaining wall extending above an earth surface such as in a subaqueous location.

U.S. Pat. No. 3,345,824 is also of interest for its disclosure of the use of concrete filled fabric bags for repairing cracks in preexisting subaqueous structures.

SUMMARY OF THE INVENTION

The present invention makes possible the economical installation of a sturdy water retaining wall extending up from the surface of the earth such as at a subaqueous location. According to the present invention a plurality of cylinder piles are installed in closely spaced relationship in a line along which the water retaining wall is to extend. These piles are preferably precast of concrete and are driven into the earth to a depth such that the portion of each pile remaining above the earth's surface, which corresponds to the height of the wall, will be laterally supported. These piles are positioned such that the spaces between them are less than their radius. Elongated fabric bags are then positioned in the spaces between adjacent piles to extend along their length. A hardenable material, such as cement, concrete grout or asphalt, is then pumped into the bags to expand them against the adjacent piles so that the bags conform to the shape of these surfaces. Because of the cylindrical configuration of the piles the expanded bags assume an hourglass shaped cross sectional shape which interlocks with the piles and provides wedge like sealing elements fitted against the piles.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other arrangements or modifications for carrying out the several purposes of the invention. It is important, therefore, that the claims be regarded as including such equivalent arrangements or modifications as do not depart from the spirit and scope of the invention.

BRIEF DESCRIPTION OF THE DRAWINGS

Certain specific arrangements for carrying out the invention have been chosen for purposes of illustration and description, and are shown in the accompanying drawings, forming a part of the specification wherein:

FIGS. 8 and 9 are views similar to FIG. 6 and showing steps in the filling of the bag and cage assembly;

FIGS. 12 and 13 are top plan views showing alternate cage configurations.

FIG. 14 is a perspective view of an alternate grout supply means for use in an alternate embodiment of the invention;

FIGS. 15 and 16 are fragmentary elevation views, in section, showing steps in filling a bag with the grout supply means of FIG. 14;

FIG. 17 is a top plan view of a bag supported by the grout supply means of FIG. 14;

FIG. 18 is a fragmentary perspective view showing an alternate bag configuration;

FIG. 19 is a perspective view, partially cut away of the bag of FIG. 18 positioned between two cylindrical piles; and FIGS. 20 and 21 are section views showing the lower end of the bag of FIG. 18 before and after the adjacent silty material flows back against the outer surface of the bag.

DETAILED DESCRIPTION OF THE PREFERRED EMBODIMENT

Figure 1:
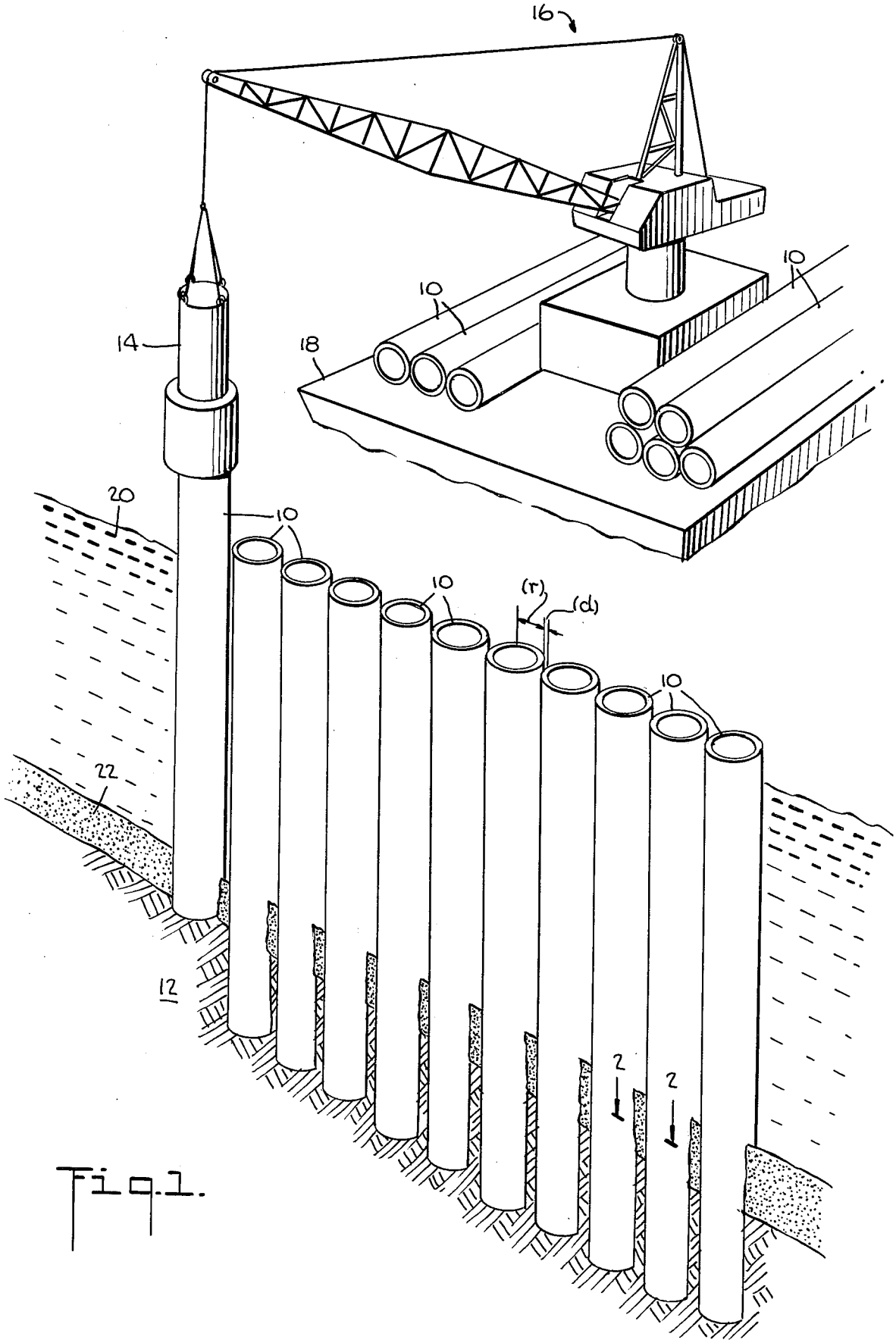
FIG. 1 is a perspective view showing a series of cylinder piles being driven from a hammer supported by a barge and constituting a first step in carrying out the present invention.

As shown in FIG. 1, the construction of a water retaining wall, according to the present invention, is carried out by first driving a series of cylinder piles 10 into the earth at a subsea supporting bed 12. These cylinder piles are of hollow concrete construction and are preferably precast as described, for example, in U.S. Pat. No. 2,826,800.

The piles 10 are driven by means of a hammer 14 of any known type; and the hammer in turn may be suspended from a derrick 16 mounted on a barge 18. The barge 18 may also be used to carry additional piles 10 to be driven. As shown, each pile 10 is held at one end by the hammer 14 and is then lowered vertically down through a body of water 20 to a non-supportative silty stratum 22 overlying the supporting bed 12. The hammer 14 is then put into operation to drive the pile 10 down through the silty stratum 22 and into the supporting bed 12. The piles 10 are driven to a depth sufficient to allow the supporting bed 12 to hold the piles securely against expected lateral water loads and other forces. The piles 10 are of sufficient length to extend up above the surface of the water 20 after they have been driven.

Figure 2:
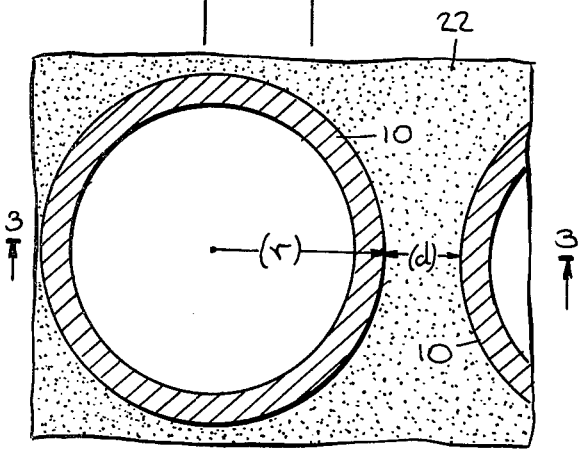
FIG. 2 is an enlarged section view taken along line 2—2 of FIG. 1.

As can be seen in FIGS. 1 and 2 the piles 10 are positioned in closely spaced relationship, i.e. at a distance (d) from each other which is less than their radius (r). It is not necessary that the piles 10 be in perfect alignment or that they be exactly parallel to each other. It is a feature of this invention that minor variations in positioning and alignment of the cylinder piles 10 can be accommodated.

Figure 3:
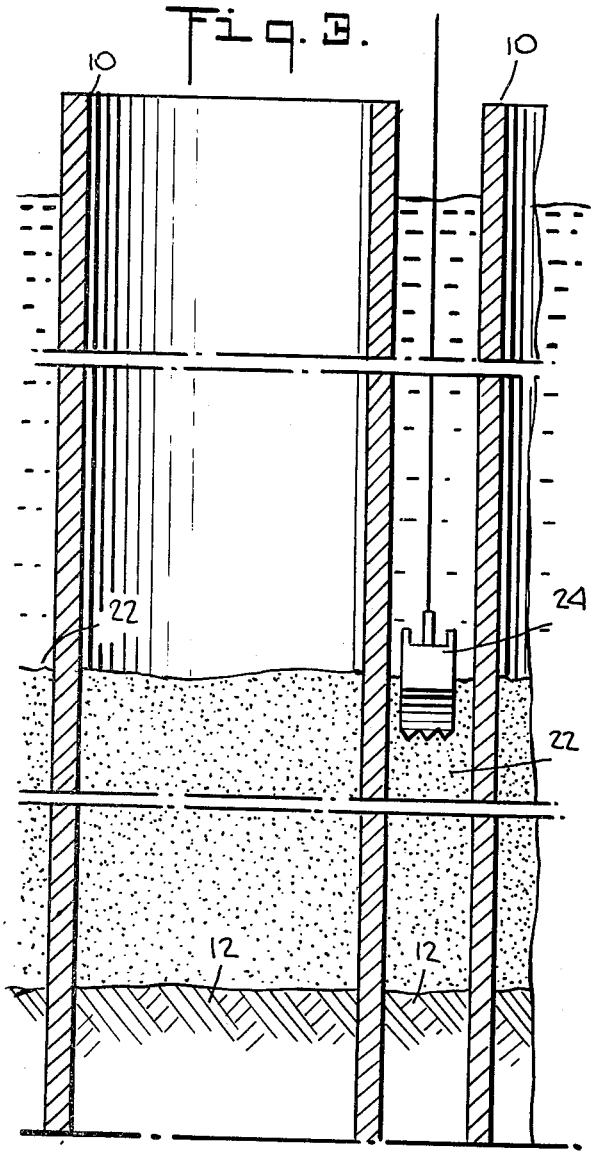
FIG. 3 is a fragmentary elevational view, in section, of a portion of the series of cylinder piles of FIG. 1 and showing a second step in carrying out the present invention.

After some or all of the piles 10 have been driven, the region of the silty stratum 22 between adjacent driven piles is excavated, for example by means of an excavating bucket 24 as shown in FIG. 3. Well known jetting techniques may also be empolyed. This excavation is carried out down to the level of the supporting bed 12, or at least down to a level below which water will not flow laterally to any appreciable extent.

Figure 4:
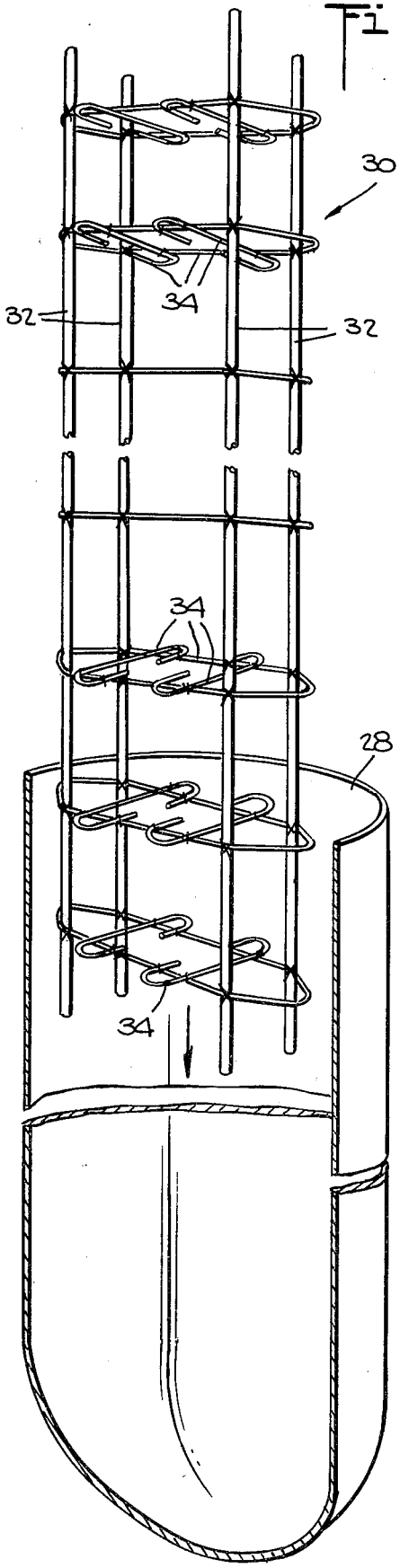
FIG. 4 is a perspective view, partially cut away, showing a bag and cage assembly used in forming fillers between the cylinder piles of FIG. 1.

Following the excavation operation an interpile filler assembly is prepared, as shown in FIG. 4, for each of the longitudinal spaces between adjacent driven piles. This interpile filler assembly comprises an elongated flexible bag 28 of a strong fabric-like material such as nylon and an elongated reinforcing framework cage 30 which is positioned inside the bag. The bag 28 is closed at its lower end and is open at the top. The bag is also of sufficient length to extend from the bottom of the excavated region between adjacent driven piles 10 to the top of the pile or at least to a level above the surface of the water 20.

The reinforcing framework cage 30 is made up of a plurality of vertical bars 32 of conventional reinforcing steel and these bars are held in spaced apart parallel relationship by means of lateral wire or rod spacers 34. The lateral spacers may be wired or welded to the vertical bars 32 to form a self supporting structure. As can be seen in FIG. 4 the framework cage 30 fits loosely inside the bag 28. Also the framework cage 30 is approximately the same length as the bag.

Figure 6:
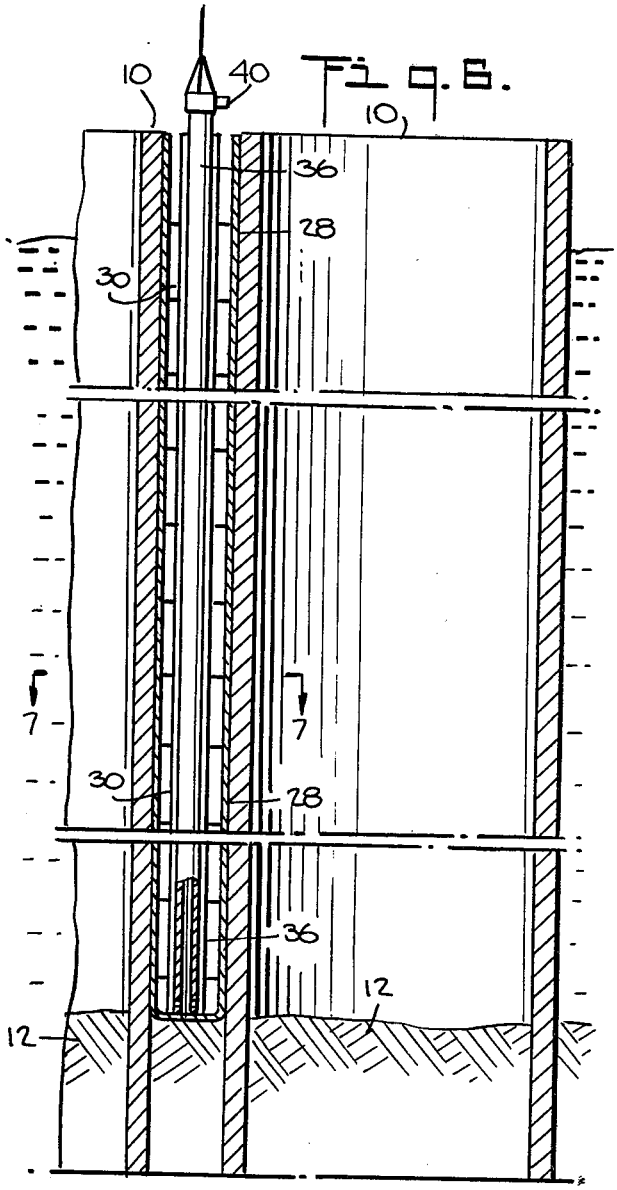
FIG. 6 is a view similar to FIG. 3 but showing a bag and cage assembly positioned between adjacent cylinder piles.
Figure 5:
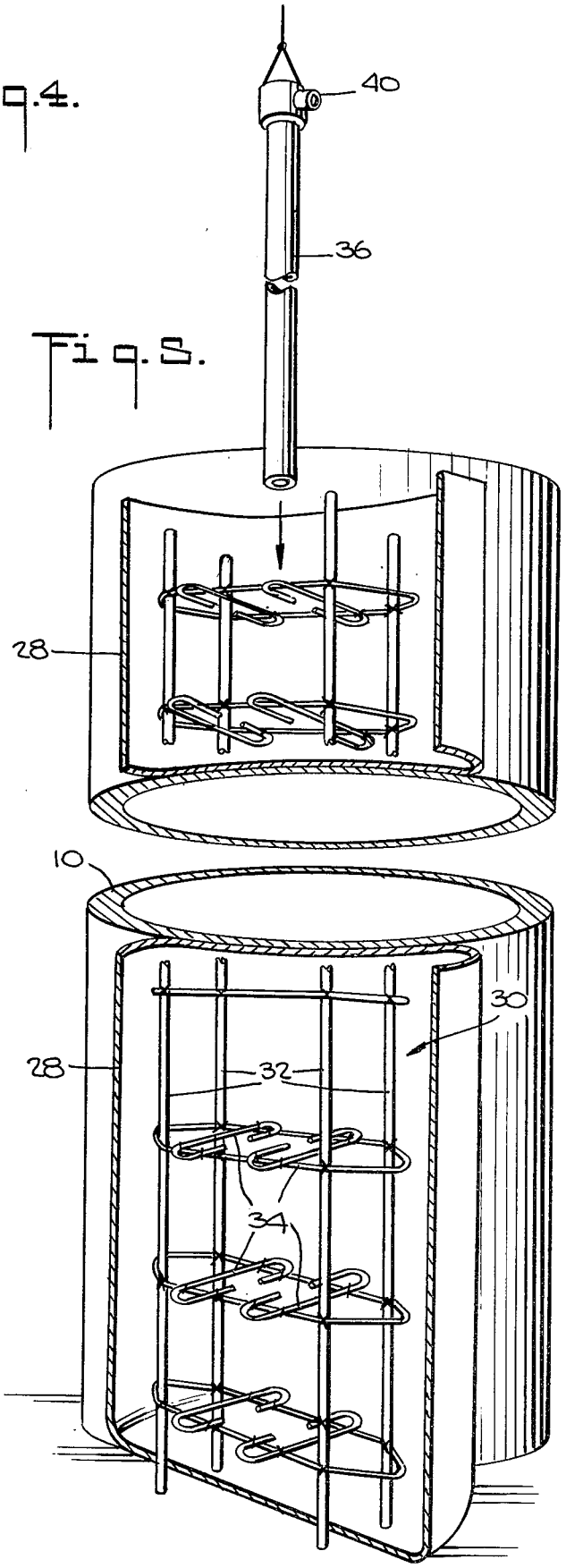
FIG. 5 is a perspective view similar to FIG. 4 and further showing the placement of the bag and cage assembly adjacent a cylinder pile with a grout filler pipe positioned for filling the bag and cage assembly.

After or during the assembly of the bag 28 and the framework cage 30, a grout pipe 36 is lowered, as shown in FIG. 5, down through the reinforcing cage to the bottom or closed end of the bag 28; and the bag, cage and grout pipe assembly is lowered down into a space between adjacent driven cylinder piles 10. As can be seen in FIG. 6, this assembly is lowered down to the bottom of the excavated region between the adjacent cylinder piles. The grout pipe 36 is of sufficient length to extend up above the open end of the bag 28 when the assembly is in place.

Figure 7:
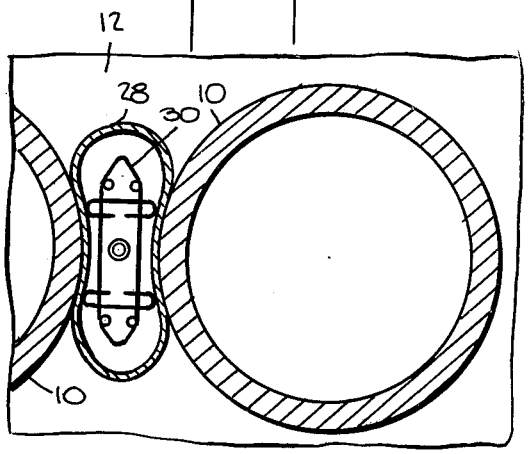
FIG. 7 is a section view taken along line 7—7 of FIG. 6.

It will be noted from FIG. 7, that the framework cage 30 has lateral dimensions which permit it and the bag 28 to fit closely but loosely in the space between adjacent piles 10. Also, the cross sectional perimeter of the bag 28 is substantially greater than that necessary to extend between the adjacent piles. By way of example, where the cylinder piles 10 are fifty four inches (137 cm) in diameter, and are set at a spacing of about twelve inches (30 cm), the cross sectional perimeter of the bag 28 may be ninety four inches (228 cm).

After the cage and bag assembly has been positioned between adjacent cylinder piles 10, a grout supply pump 38 is connected via a supply line 40 to the upper end of the grout pipe 36. The supply pump is then put into operation to force a hardenable substance such as wet cement or concrete grout through the supply line 40 and down through the grout pipe 36 to the bottom of the bag 28. As the grout begins to fill the bag the grout pipe 36 is lifted, as shown in FIG. 9, until eventually the entire bag 28 is filled.

Figure 10:
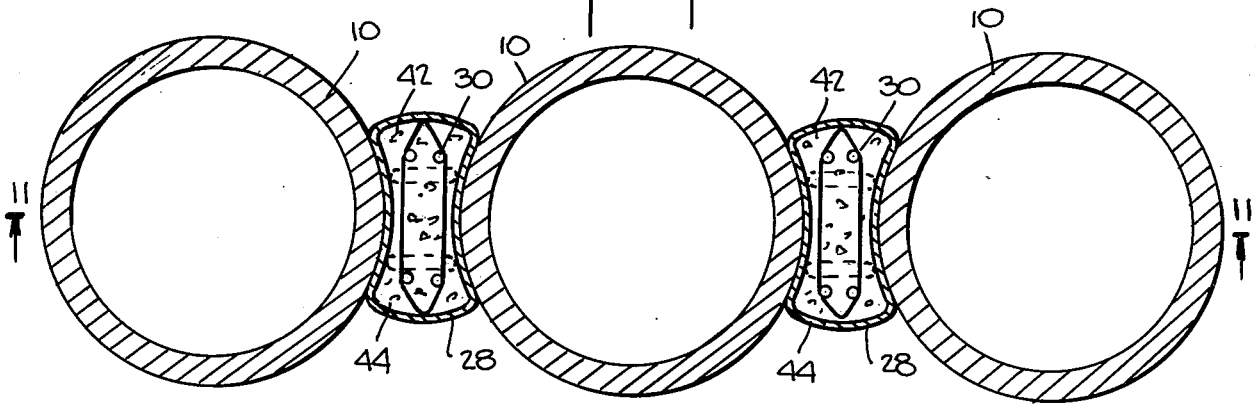
FIG. 10 is a top plan view of a plurality of installed cylinder piles with filled bag and cage assemblies according to the present invention.

The hydrostatic pressure of the grout expands the bag 28 so that it spans the entire distance between the adjacent cylinder piles 10 and presses against their mutually facing surfaces as shown in FIG. 10 to form an elongated filler element between adjacent piles. It will be noted that this filler element assumes an hourglass or dumbell cross sectional shape with two wedgelike segments 42 and 44 which, when the cement or concrete hardens, are locked to the cylinder piles. Moreover these wedgelike segments are so shaped that they act as a stopper when subjected to lateral hydrostatic pressure and serve to provide a tight seal against the cylinder piles. Further, the adjacent surfaces of the cylinder piles provide a large supporting area for these segments and protect them from highly concentrated stresses. It will also be appreciated that the flexible bag arrangement accommodates variations in the alignment or spacing between the adjacent cylinder piles. It is only important that the cylinder pile spacing be close enough in relationship to the bag perimeter so that the wedgelike segments can be developed during filling.

Figure 11:
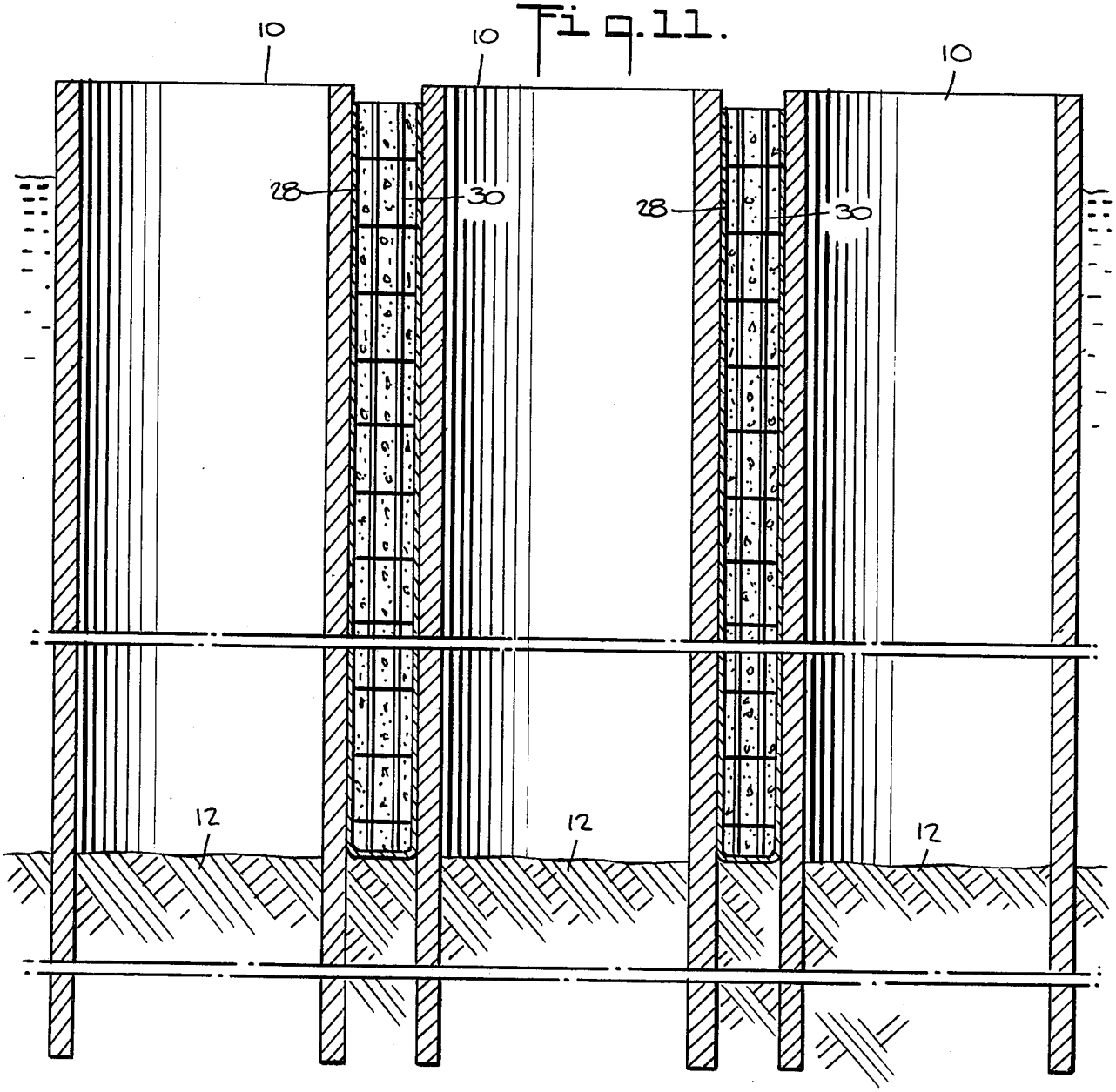
FIG. 11 is a section view taken along line 11—11 of FIG. 10.

As can be seen in FIG. 11 the finished wall is of concrete construction with the cylinder piles 10 providing the major portion of the surface area and substantially the entire structural support for the wall. The grout filled bags 28 in turn provide a seal between the adjacent piles 10 and serve to convert the assembly of discrete piles into a continuous wall structure.

In the event that the non-supportative silty stratum 22 is a high density soil, such as clay, which may flow back into the excavated region, the cement grout pumping should be carried out at high pressure to maintain sufficient force inside the bag 28 to keep it expanded against the pinching effects of the surrounding soil until the grout has hardened.

FIGS. 12 and 13 show in cross section alternate reinforcing framework cages 46 and 48 which may be used in situations where lateral forces may tend to shift the entire bag and cage assembly out from between adjacent cylinder piles before the bag is filled with grout. As can be seen in FIG. 12 the cage 46 is made up of six vertical bars 50 arranged in an hourglass array. The outermost of these bars are spaced apart from each other by an amount greater than the space between the cylinder piles so that the cage 46 itself is effectively locked in place even without the placement of grout.

In the arrangement of FIG. 13 the cage 48 is made up of only four vertical bars 52 held in spaced apart relation by suitable criss-crossed spacer elements 54. Again the spacing of the bars 52 is greater than the space between the cylinder piles 10 and the cage 48 is also effectively locked in place.

FIGS. 12 and 13 also show the provision of outer spacer elements 56 positioned on the spacer elements 54. The purpose of these outer spacer elements is to hold the material of the bag 28 out away from the reinforcing framework cages before grout is pumped into the bag. This will ensure that the reinforcing framework cages will be properly centered in the bags when they are filled with grout.

In some applications where a substantial amount of flexing of the cylinder piles 10 may be expected, a hardenable filler material having more plasticity than cement grout may be used in the bags 28. One such material is hydraulic asphalt or asphalt cement. Such an arrangement will provide an elastic seal between the cylinder piles. Other filler materials may also be used such as epoxy resin compounds which are highly elastic. These latter compounds can be mixed with sand and gravel bulk fillers to produce the closure or seal between the cylinder piles.

It should be understood that there may be situations where reinforcing cages or other reinforcing structures are not needed. In such case the bag 28 will be filled with grout or other suitable substance but no reinforcing bars or similar elements would be provided.

FIGS. 14–17 illustrate an embodiment of the invention where no reinforcing cage is employed. In this embodiment, however, special spacer arrangements are provided to maintain the bag 28 properly positioned while it is being filled with grout or other filler material.

In FIGS. 14–17 the same reference numerals are used as in the preceding embodiment for like parts.

FIG. 14 shows an alternate form of grout supply means for filling the bag 28. This alternate grout supply means comprises an inner grout pipe 60 telescoped inside an outer grout pipe 62. The inner grout pipe 60 may be of the same general construction as the grout pipe 36 of the preceding embodiment; and it fits loosely inside the outer grout pipe 62. The outer grout pipe 62 is formed with a plurality of openings 64 distributed about its circumference and along its length. In addition there are provided a plurality of bow shaped spacer elements 66 which are welded or otherwise attached to the outer surface of the outer grout pipe 62.

As shown in FIG. 15, the assembly of inner and outer grout pipes 60 and 62 is positioned inside a bag 28 and is lowered, with the bag, down between adjacent cylinder piles 10. As can be seen in FIGS. 15 and 17, the spacer elements 66 hold the bag 28 away from the grout pipes 60 and 62 and they maintain the bag in partially expanded condition against the adjacent piles 10.

Grout is then pumped to flow from the supply line 40 down through the inner pipe 60. The inner pipe 60 is then raised, as shown in FIG. 16, while the outer pipe 62 remains stationary. The grout being pumped exits via the lower end of the inner pipe 60 as it is raised and passes through the openings 64 of the outer pipe 62 and into the bag 28. The bag thereby becomes filled with grout from the bottom to the top as the inner pipe 60 is raised during the pumping operation. The bag 28 expands, as previously explained, to an hourglass cross-sectional shape wedged between the adjacent cylinder piles 10. It will be noted that the outer pipe 62 remains inside the concrete filled bag 60. This outer pipe may or may not provide reinforcement to the grout after it has hardened, depending upon the requirements and the material of the outer pipe. The provision of the inner/-outer telescoping grout pipe arrangement of FIGS. 14–17 facilitates the lifting of the inner pipe during pumping of the grout and it ensures that the bag 28 is fully and uniformly filled and expanded to a proper configuration.

FIGS. 18–21 show an additional modification which may be used where the silty stratum 22 is so soft and heavy that it flows back into the excavation into which the bag 28 is to be positioned. As can be seen in FIGS. 18–21 there is provided a rigid metal form 70 of hourglass cross-sectional configuration and dimensioned and shaped to fit closely between adjacent piles 10. The lower end of the form 70 is closed and the upper end is secured to the open bottom of the bag 28. The length of the metal form 70 should be sufficient to extend from the bottom of the excavation up to or substantially up to the top of the silty stratum 22.

As shown in FIGS. 18 and 20, the bag 28, with the form 70 attached, is lowered down between the adjacent cylinder piles 10 after excavation of the silty stratum 22 but before the silty material has flowed back into the excavation. Thereafter, as shown in FIG. 21, when the silty material flows back in toward the excavation the rigid metal form 70 will resist the forces of the material and will maintain its configuration until grout or other suitable filler material is injected into and hardens in the form and the bag.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A concrete wall structure comprising a plurality of concrete piles of cylindrical cross section positioned adjacent each other and extending into and supported by a supporting bed in the earth and elongated filler elements arranged in the spaces between adjacent ones of said piles and above said supporting bed, each filler element including a framework cage and a hardenable substance encased within an elongated tubular bag, said framework cage being arranged and configured with portions positioned on the opposite sides of the smallest span between adjacent cylinder piles and having a greater dimension on each side of said span than the span itself, said filler elements also having an hourglass shaped cross section which conforms to the shape of and abuts against the outer wall surfaces of adjacent ones of said concrete piles.

2. A concrete wall structure according to claim 1 wherein said hardenable substance is cement grout.

3. A concrete wall structure according to claim 1 wherein each framework cage includes elongated reinforcing rods.

4. A concrete wall structure according to claim 1 wherein said tubular bags are of a flexible fabric material.

5. A concrete wall structure according to claim 4 wherein said filler elements further include a rigid form extending from the lower end of said bag and forming the bottom thereof.

6. A concrete wall structure according to claim 5 wherein said rigid form has an hourglass shaped cross section.

7. A concrete wall structure according to claim 1 wherein said hardenable substance is an asphalt material.

8. A concrete wall structure according to claim 1 wherein said supporting bed is under a body of water.

9. A concrete wall structure according to claim 8 wherein said filler elements extend from a location above said body of water to a location adjacent said supporting bed in the earth.

10. A concrete wall structure according to claim 9 wherein a non-supportative earth layer rests upon said supporting bed and wherein said filler elements extend down through said non-supportative layer.

11. A concrete wall structure according to claim 1 wherein said concrete piles are precast tubular cylinder piles.

12. A concrete wall structure according to claim 1 wherein the spacing between said piles is less than their radius.

13. A concrete wall structure according to claim 1 wherein spacer elements are mounted on each framework cage.

14. A concrete wall structure comprising a plurality of concrete piles of cylindrical cross section positioned adjacent each other and extending into and supported by a supporting bed in the earth and elongated filler elements, each including a hardenable substance encased in an elongated tubular bag, arranged in the spaces between adjacent ones of said piles, said filler elements having an hourglass shaped cross section which conforms to the shape of and abuts against the outer wall surfaces of adjacent ones of said concrete piles, wherein spacer elements are positioned inside said bag, said spacer elements being mounted on an elongated filing tube which extends down through the interior of said bag.

15. A method of forming a water retaining wall extending up from the surface of the earth, said method comprising the steps of installing a plurality of cylinder piles in the earth to be supported thereby and to extend up from the surface thereof in closely spaced, substantially parallel relationship, inserting elongated, tubular, flexible wall bags into the spaces between adjacent ones of said piles to extend along the length thereof above the earth, flowing a hardenable material into the bags through a filler pipe which extends down from the upper end of each bag and which is gradually raised to expand each bag against the mutually facing surfaces of the adjacent piles so that the bag conforms to the shape of said surfaces and becomes interlocked with said piles when said material hardens to form a continuous integral wall, wherein said filler pipe is initially telescopically arranged in an outer pipe and is withdrawn out from said outer pipe while said hardenable material flows out from the bottom of said filler pipe and passes through openings along the length of said outer pipe into said bag.

16. A method of forming a water retaining wall extending up from the surface of the earth, said method comprising the steps of installing a plurality of cylinder piles in the earth to be supported thereby and to extend up from the surface thereof in closely spaced, substantially parallel relationship, inserting elongated, tubular, flexible wall bags into the spaces between adjacent ones of said piles to extend along the length thereof above the earth, providing within each bag a cage-like framework arranged and configured with portions positioned on opposite sides of the smallest span between adjacent cylinder piles and having a greater dimension on each side of said span than the span itself to prevent the framework or the bag in which it is contained from moving laterally between adjacent piles, thereafter flowing a hardenable material into the bags to expand each bag against the mutually facing surfaces of the adjacent piles so that the bag conforms to the shape of said surfaces and becomes interlocked with said piles when said material hardens to form a continuous integral wall.

17. A method of forming a wall according to claim 16 wherein said piles are driven into the earth beneath a body of water.

18. A method of forming a wall according to claim 17 wherein said piles are driven down through a non-supportative layer and into a supportative layer in the earth and wherein, after said driving, the non-supportative layer is removed from around said piles and said bags are installed to extend down to said supportative layer.

19. A method of forming a wall according to claim 16 wherein each bag is pulled over the associated cage-like framework prior to being positioned between adjacent piles.

20. A method of forming a wall according to claim 16 wherein said hardenable material is flowed into a filler pipe extending down from the upper end of each bag is wherein the filler pipe is raised gradually and the pipe is filled.

21. A method of forming a wall according to claim 16 wherein said bags are held in partially expanded condition by spacer elements mounted on each cage-like framework.

* * * * *